US007968481B2

(12) United States Patent
Matsui et al.

(10) Patent No.: US 7,968,481 B2
(45) Date of Patent: Jun. 28, 2011

(54) HOT-MELT CONJUGATE FIBER

(75) Inventors: Manabu Matsui, Haga-gun (JP); Takeshi Kikutani, Tokyo (JP)

(73) Assignee: KAO Corporation, Tokyo (JP)

( * ) Notice: Subject to any disclaimer, the term of this patent is extended or adjusted under 35 U.S.C. 154(b) by 458 days.

(21) Appl. No.: 10/540,474

(22) PCT Filed: Dec. 19, 2003

(86) PCT No.: PCT/JP03/16367

§ 371 (c)(1),
(2), (4) Date: Jun. 23, 2005

(87) PCT Pub. No.: WO2004/059050

PCT Pub. Date: Jul. 15, 2004

(65) Prior Publication Data

US 2006/0063457 A1 Mar. 23, 2006

(30) Foreign Application Priority Data

Dec. 24, 2002 (JP) ..... 2002-371283

(51) Int. Cl.

| | |
|---|---|
| ***D04H 1/06*** | (2006.01) |
| ***D01D 5/00*** | (2006.01) |
| ***D01D 5/32*** | (2006.01) |
| ***D01D 5/34*** | (2006.01) |
| ***D02G 3/00*** | (2006.01) |

(52) U.S. Cl. ... 442/364; 442/361; 442/362; 264/172.11; 264/172.14; 264/172.15; 428/373; 428/374

(58) Field of Classification Search ..... 442/199–200, 442/361–364; 264/172.11–172.17; 428/373, 428/374

See application file for complete search history.

(56) References Cited

U.S. PATENT DOCUMENTS

| | | | | |
|---|---|---|---|---|
| 4,269,888 | A | 5/1981 | Ejima et al. | |
| 4,469,540 | A * | 9/1984 | Furukawa et al. | 156/62.4 |
| 5,733,825 | A * | 3/1998 | Martin et al. | 442/361 |
| 5,780,155 | A * | 7/1998 | Ishizawa et al. | 428/370 |

(Continued)

FOREIGN PATENT DOCUMENTS

| | | |
|---|---|---|
| CN | 1066502 | 5/2001 |

(Continued)

OTHER PUBLICATIONS

Stibel, Werner; Fibers, 3 General Production Technology, Ullmann's Encyclopedia of Industrial Chemistry, Online Posting date Sep. 15, 2001.*

(Continued)

*Primary Examiner* — Angela Ortiz
*Assistant Examiner* — Jennifer Steele
(74) *Attorney, Agent, or Firm* — Birch, Stewart, Kolasch & Birch, LLP

(57) ABSTRACT

A heat fusible conjugate fiber produced by high-speed melt spinning is disclosed. The conjugate fiber is composed of a first resin component having an orientation index of 40% or higher and a second resin component having a lower melting or softening point than the melting point of the first resin component and an orientation index of 25% or lower. The second resin component is present on at least part of the surface of the fiber in a lengthwise continuous configuration. The conjugate fiber preferably has a heat shrinkage of 0.5% or less at a temperature higher than the melting or softening point of the second resin component by 10° C.

6 Claims, 2 Drawing Sheets

U.S. PATENT DOCUMENTS

| | | | | |
|---|---|---|---|---|
| 5,800,230 | A * | 9/1998 | Horiuchi et al. | 442/352 |
| 6,543,105 | B1 * | 4/2003 | Kemp et al. | 28/274 |

FOREIGN PATENT DOCUMENTS

| | | | | |
|---|---|---|---|---|
| JP | 50095519 | A | * | 9/1975 |
| JP | 54-38214 | B | | 11/1979 |
| JP | 62-184173 | A | | 8/1987 |
| JP | 1-40618 | A | | 2/1989 |
| JP | 8-60441 | A | | 3/1996 |
| JP | 11-158766 | A | | 6/1999 |
| JP | 11-323663 | A | | 11/1999 |
| JP | 2001-3253 | A | | 1/2001 |
| JP | 3322868 | B1 | | 6/2002 |
| JP | 2003-119625 | A | | 4/2003 |
| JP | 2003119625 | A | * | 4/2003 |

OTHER PUBLICATIONS

"Polypropylene, An A-Z reference" p. 431 edited by J. Karger-Kocsis, published by Kluwer Academic publishers, 1999.*

Textile Glossary, p. 25 and 26, Celanese Acetate LLC, 2001 copyright.*

English language abstract of JP 09273060 (Oct. 21, 1997).

* cited by examiner

HOT-MELT CONJUGATE FIBER

TECHNICAL FIELD

The present invention relates to heat-fusible conjugate fiber. The present invention also relates to bulky nonwoven fabric.

BACKGROUND ART

Sheath-core conjugate fibers produced by high-speed melt spinning are known. For example, JP-B-54-38214 discloses a process of producing a conjugate fiber, in which a fiber-forming crystalline polymer as a core component and a polymer having a softening point lower than the softening point of the crystalline polymer by at least 40° C. as a sheath component are spun in a sheath-core configuration at a sheath component weight ratio of 5 to 75% and taken up at a speed of 3200 to 9800 m/min.

The publication alleges that the conjugate fiber obtained by the process has reduced heat shrinkage. However, the actual heat shrinkage (boiling water shrinkage) percentages are in a range of from 12.7% to 37.2%, which cannot be seen as sufficiently small to manufacture nonwoven fabric by thermally bonding the fibers at the intersections. The publication mentions that the conjugate fiber mass can be opened using air to form a web and that the conjugate fiber can be converted into staple as a material of staple nonwoven fabric but gives no considerations to web formation using a card.

Various proposals have been made to manufacture nonwoven fabric with improvements in bulk, strength, and feel by using conjugate fibers. For instance, JP-A-8-60441 proposes using a three-dimensionally crimped heat fusible conjugate fiber composed of crystalline polypropylene as a first component and polyethylene as a second component to provide a nonwoven fabric with improved strength and recovery of bulk. JP-A-11-323663 proposes using a heat fusible conjugate fiber the cross-section of which is modified to have branches extending in strands to provide nonwoven fabric with a pleasant feel. JP-A-2001-3253 proposes a bulky nonwoven fabric having (1) thermobonded parts in which heat fusible conjugate fibers are thermally bonded but are not compressed nor flattened and (2) non-thermobonded parts. However, since bulkiness or feel and strength of nonwoven fabric conflict with each other, there has been no nonwoven fabric satisfying all these requirements.

SUMMARY OF THE INVENTION

To achieve its object, the present invention provides a heat fusible conjugate fiber produced by high-speed melt spinning. The heat fusible conjugate fiber is composed of a first resin component having an orientation index of 40% or higher and a second resin component having a lower melting or softening point than the melting point of the first resin component and an orientation index of 25% or lower. The second resin component is present on at least part of the surface of the fiber in a lengthwise continuous configuration.

The present invention also provides a nonwoven fabric produced by providing a carded web containing the above-described heat fusible conjugate fibers and heat fusing the intersections of the fibers in the web.

The present invention also provides a bulky nonwoven fabric containing heat fusible conjugate fibers consisting of two components having different melting points, being formed by heat fusing the intersections of the fibers, and having a specific volume of 95 $cm^3/g$ or more, a strength per basis weight of 0.18 (N/25 mm)/($g/m^2$) or higher, and a bulk softness per unit thickness of 0.14 N/mm or less.

DETAILED DESCRIPTION OF THE INVENTION

The present invention relates to a heat fusible conjugate fiber which has low heat shrinkage, develops high fusion bond strength with a small amount of heat applied, and exhibits satisfactory carded web-forming capabilities. The invention also relates to a bulky and strong nonwoven fabric.

The present invention will be described based on its preferred embodiments. The conjugate fiber of the present invention is a bi-component fiber composed of a first resin component and a second resin component having a lower melting or softening point than the melting point of the first resin component. The second resin component is present on at least part of the surface of the individual fiber in a lengthwise continuous configuration. The conjugate fiber of the present invention can take any form, such as a sheath-core configuration and a side-by-side configuration. The conjugate fiber of the invention preferably has a concentric or eccentric sheath-core configuration, especially a concentric sheath-core configuration.

Figure 1:
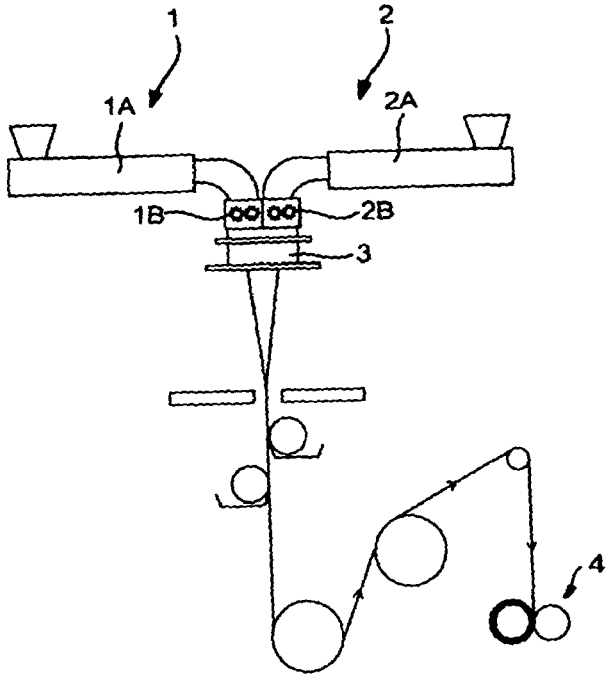
FIG. 1 is a schematic showing apparatus used in high-speed melt spinning.

The heat fusible conjugate fiber of the present invention is produced by high-speed melt spinning. High-speed melt spinning is carried out with a spinning apparatus shown in FIG. 1, which has two extrusion units 1 and 2 including extruders 1A and 2A and gear pumps 1B and 2B, respectively, and a spinning unit equipped with a spinneret 3. Two resin components are separately melted and metered through the respective extruders 1A and 2A and the respective gear pumps 1B and 2B, joined together in the spinneret 3, and ejected through nozzles. The design of the spinneret 3 is selected properly according to the configuration of a conjugate fiber to be produced. Right under the spinneret 3 is placed a winder 4, whereby the molten resin ejected from the nozzles is taken up at a prescribed speed. The take-up speed in high-speed melt spinning is usually 2000 m/min or higher. There is no particular upper limit of the take-up speed. The latest melt spinning technology makes it feasible to take up fibers at a speed exceeding 10000 m/min.

The first resin component making up the heat fusible conjugate fiber functions to maintain the strength of the conjugate fiber, while the second one contributes to heat fusibility. The first resin component has an orientation index of 40% or higher, preferably 50% or higher, while the second one has an orientation index of 25% or lower, preferably 20% or lower. An orientation index is an indication of the degree of orientation of the polymer chains constituting the fiber. When the first and the second resin components have the above-recited orientation indices, it allows for formation of high-strength fusion bonds (fusion bonded joints) with a small quantity of heat and suppression of heat shrinkage. More specifically, when the orientation index of the first resin component is lower than 40%, the first resin component has insufficient crystallinity, failing to develop sufficient strength for practical use. When the orientation index of the second resin component exceeds 25%, it is difficult for the fiber to form high-strength fusion bonds with a small heat quantity (at low temperature) due to insufficient heat fusibility. The heat fusible conjugate fiber having the first and the second resin components with the recited respective orientation indices can be obtained by, for example, melt spinning two resins having different melting points by the aforementioned high-speed melt spinning.

It is preferred for the first resin component to have as high an orientation index as possible. There is no particular upper limit therefor. Nevertheless, about 70% would suffice for satisfactory results. It is preferred for the second resin component to have as low an orientation index as possible. While there is no particular lower limit therefor, about 15% would suffice for obtaining satisfactory results.

The orientation index of the first and the second resin components can be represented by equation (1) shown below, wherein A is a birefringence value of the resin in the conjugate fiber, and B is an intrinsic birefringence value of the resin.

$$\text{Orientation index (\%)} = A/B \times 100 \quad (1)$$

Intrinsic birefringence is birefringence of a resin with its polymer chains perfectly oriented. Intrinsic birefringence values of typical plastic materials are given in, for example, the Japan Society of Polymer Processing (ed.), Materials for Polymer Processing (1st ed.), appendix table, Sigma Publishing Co., Ltd., 1998.2.10.

Birefringence of the resins in the conjugate fiber is determined with an interference microscope equipped with a polarizer under light polarized in the directions parallel with, and perpendicular to, the fiber axis. The standard refractive index fluid available from Cargille Lab. is used as an immersion oil. The refractive index of the immersion oil is measured with an Abbe refractometer. Refractive indices in the directions parallel with and perpendicular to the fiber axis are obtained from the interference fringe patterns obtained with the interference microscope in accordance with the calculation method described in the paper titled "Fiber Structure Formation in High-Speed Melt Spinning of Sheath-Core Type Bicomponent Fibers", Seni Gakkaishi, vol. 51, No. 9, p 408, 1995. A birefringence value is then obtained as a difference between the two refractive indices.

The conjugate fiber of the present invention is preferably one obtained by spinning followed by a heat treatment or a crimp treatment but not followed by drawing. By so doing, the resulting conjugate fiber has low heat shrinkage. Specifically, the conjugate fiber thus obtained has a heat shrinkage as low as 5% or less, preferably 1% or less, more preferably 0.5% or less, at a temperature higher by 10° C. than the melting or softening point of the second resin component. As a result, when the conjugate fiber of the present invention is used as a constituent fiber of nonwoven fabric, nonwoven fabrics with high bulk and high strength can be obtained, as will be further described later. The heat shrinkage percentage is preferably as small as possible, ideally zero. The heat shrinkage values could be negative (minus). In other words, the fiber may increase in length on heating, which favors production of bulky nonwoven fabrics. The upper limit of the absolute value of negative heat shrinkage percentages is preferably about −20%, more preferably about −10%, from the viewpoint of texture control and fabric appearance. The reason the heat shrinkage measurement is made at the above-defined temperature is that heat fusion bonding of fibers at their intersections to fabricate nonwoven fabric is usually carried out in a temperature range from the melting or softening point of the second resin component up to a temperature higher than that point by about 10° C.

The heat shrinkage is measured with a thermomechanical analyzer TMA-50 (from Shimadzu Corp.). Fibers arranged in parallel are set with a chuck distance of 10 mm and heated at a rate of temperature rise of 10° C./min under a constant load of 0.025 mN/tex applied. The change in length of the fibers is recorded. The shrinkage percentage at a temperature higher than the melting or softening point of the second resin component by 10° C. is taken as the heat shrinkage.

The conditions of the heat treatment carried out after the spinning are decided appropriately according to the kinds of the first and the second resin components making up the conjugate fiber of the present invention. For instance, a sheath-core conjugate fiber having a high-density polyethylene sheath and a polypropylene core is preferably heated at 50° to 120° C., more preferably 70° to 100° C., for 10 to 500 seconds, even more preferably 20 to 200 seconds. Methods of heating include hot air blowing and irradiation with infrared light.

The crimp treatment after the spinning is conveniently carried out by mechanical crimping. Mechanical crimps include a two-dimensional crimp, a three-dimensional crimp, either of which is effective in the present invention. Mechanical crimping sometimes involves heat application. In that case, the fiber is to be subjected to a heat treatment and a crimp treatment simultaneously.

While a crimp treatment sometimes involves elongation of fibers, such elongation is not included under "drawing" as referred to in the present invention. The term "drawing" as used herein is intended to denote an operation of about 2- to 6-fold stretching that is commonly conducted on undrawn continuous yarn.

The conjugate fiber of the present invention, as stated above, typically has a sheath-core configuration. In order to minimize heat shrinkage of the conjugate fiber, it is preferred that the first resin component make the core, and the second one the sheath. The first and the second resin components are not particularly limited in kind, and any fiber-forming resins are usable. It is particularly desirable, for ease of manufacturing nonwoven fabric through heat fusion, that the difference between the two resin components in melting point or the difference between the melting point of the first resin component and the softening point of the second resin component be at least 10° C., more desirably 20° C. or greater. In the case of a sheath-core conjugate fiber, the resin components are combined so that the melting point of the core may be higher than the melting or softening point of the sheath. To give examples of preferred combinations of the first and the second resin components, polypropylene (PP) as a first resin component can be combined with high-density polyethylene (HDPE), low-density polyethylene (LDPE), linear low-density polyethylene (LLDPE), an ethylene-propylene copolymer, polystyrene, etc. In using, as a first resin component, a polyester resin such as polyethylene terephthalate (PET) or polybutylene terephthalate (PBT), the second resin component to be combined includes those recited above as examples of the second resin component and, in addition, PP and copolyesters. Useful first resin components further include polyamide resins and copolymers of two or more monomer units making up the above-enumerated first resin components. Useful second resin components further include copolymers of two or more monomer units making up the above-recited second resin components. These resins can be combined appropriately. Of various conceivable combinations, a combination of PP and HDPE is especially preferred; for one thing, their difference in melting point is in a range of 20° to 40° C., which is advantageous for ease of manufacturing nonwoven fabric; for another, the fiber has a low specific gravity, which is advantageous for providing light-weight, economical nonwoven fabric that can be disposed of by incineration with a small amount of heat.

The method of measuring the melting points of the first and the second resin components will be described in detail in Examples hereinafter given. In case where the melting point of a second resin component is not clearly measurable by that method, the temperature at which the second resin component fuses to itself to form a fusion bond having a bond strength measurable in the fusion bond strength measurement described later in Examples is taken as a softening point at which the molecules of the second resin component begin to fluidize.

A weight ratio of the first to the second resin components in the conjugate fiber of the present invention is preferably 10:90 to 90:10(%), more preferably 30:70 to 70:30(%). As long as the ratio falls within that range, the fiber exhibits sufficient dynamic characteristics for practical use, and the proportion of the fusible component is adequate for sufficient fusion among fibers.

The thickness of the conjugate fiber of the present invention is selected appropriately according to the intended use of the conjugate fiber. In application to nonwoven fabric, for example, the thickness is usually 1.0 to 10 dtex, preferably 1.7 to 8.0 dtex, from the viewpoint of ease of spinning, spinning cost, processability on a carding machine, productivity, cost, and the like.

The nonwoven fabric according to the present invention will then be described. The nonwoven fabric of the present invention contains heat fusible conjugate fibers made of two components having different melting points and is formed by heat fusing intersections of the fibers. The nonwoven fabric of the invention displays outstanding characteristics distinctive from conventional ones in bulk and strength. Specifically, the nonwoven fabric of the invention has a specific volume, indicative of bulkiness, of 95 $cm^3/g$ or larger, preferably 110 $cm^3/g$ or larger, more preferably 120 $cm^3/g$ or larger. Conventional nonwoven fabrics could have their specific volume increased by the choice of the fibers and the process of production. Such nonwoven fabrics cannot help but suffer from low strength, however. In contrast, the nonwoven fabric of the present invention has a large specific volume as recited and yet enjoys high strength. Specifically, the nonwoven fabric of the invention has a strength per basis weight of 0.18 (N/25 mm)/($g/m^2$) or higher, preferably 0.19 (N/25 mm)/($g/m^2$) or higher, more preferably 0.20 (N/25 mm)/($g/m^2$) or higher. The nonwoven fabric which has the recited strength per basis weight in its cross direction (CD) will suffice. It is desirable for the nonwoven fabric to have the recited strength per basis weight in both the machine direction (MD) and the CD. Because nonwoven fabric is usually stronger in the MD than in the CD, it can be said that a nonwoven fabric satisfying the strength requirement in the CD necessarily satisfies the requirement in the MD.

There are no particular upper limits to the specific volume and the strength per basis weight, and the higher, the better. A specific volume of not larger than about 250 $cm^3/g$ and a strength per basis weight of not higher than about 0.5 (N/25 mm)/($g/m^2$) would be enough to assure satisfactory results in various applications of the nonwoven fabric of the present invention. The methods of measuring the specific volume and the strength per basis weight will be described in Examples.

It is preferred for the nonwoven fabric of the present invention to have a bulk softness per unit thickness of 0.14 N/mm or less, more preferably 0.12 N/mm or less, even more preferably 0.10 N/mm or less. In other words, it is preferred for the nonwoven fabric of the invention to have low bulk softness, whereby the nonwoven fabric exhibits drapability and a good feel. It is sufficient that the bulk softness per unit thickness satisfies the aforementioned value in the machine direction (MD) of the nonwoven fabric. It is desirable that the nonwoven fabric has the recited bulk softness in both the MD and the cross direction (CD). Since nonwoven fabric usually has higher bulk softness in the MD than in the CD, it can be said that a nonwoven fabric satisfying the bulk softness requirement in the MD necessarily satisfies the requirement in the CD. There is no particular lower limit to the bulk softness per unit thickness, and the smaller, the better. A bulk softness of not lower than about 0.05 N/mm would be enough to assure satisfactory results in various applications of the nonwoven fabric of the present invention. The method of measuring a bulk softness per unit thickness will be described in Examples given infra.

The present inventors have found that a nonwoven fabric satisfying the aforementioned specific volume and strength requirements can be obtained from undrawn or low-drawn heat fusible conjugate fibers (hereinafter inclusively referred to as undrawn conjugate fibers). The expression "low-drawn" as used herein is intended to mean "drawn to a draw ratio of less than 2". It has also been proved effective to use a undrawn conjugate fiber having a low heat shrinkage. For example, it is effective to use an undrawn conjugate fiber having a heat shrinkage of 5% or less, preferably 1% or less, more preferably 0.5% or less, at a temperature higher by 10° C. than the melting or softening point of the second resin component. It is also effective to use an undrawn conjugate fiber the second resin component of which has a small orientation index, e.g., 25% or smaller, preferably 20% or smaller. The undrawn or low-drawn heat fusible conjugate fiber includes those obtained by converting two resins having different melting points into fiber by high-speed melt spinning at a spinning speed of 2000 m/min or higher, followed by no drawing or drawing at a low draw ratio, and those obtained by converting a combination of a core resin and a sheath resin each of which has an orientation index as designed into fiber by ordinary melt spinning, followed by no drawing or drawing to a low draw ratio. The undrawn or low-drawn heat fusible conjugate fiber is also obtainable by converting the same combination of a core resin and a sheath resin each of which has a controlled orientation index by varying the molecular weight into fiber by ordinary melt spinning, followed by no drawing or drawing to a low draw ratio.

The nonwoven fabric of the present invention is preferably one produced by heat fusing intersections of fibers in a carded web containing undrawn conjugate fibers. Such a nonwoven fabric has an increased specific volume and an enhanced strength. It is preferred for the nonwoven fabric of the present invention to contain at least 30% by weight, more preferably at least 50% by weight, of the undrawn conjugate fibers so that the various characteristics of the conjugate fibers may be manifested sufficiently. The nonwoven fabric may be made solely of the undrawn conjugate fibers. The fibers other than the undrawn conjugate fiber include conjugate fibers obtained from a combination of resins similar to that used in the undrawn conjugate fiber by ordinary spinning followed by drawing, polyester, polyolefin or polyamide single-component fibers, regenerated fibers such as rayon, cellulose fiber, and natural fibers such as cotton.

Where the web is made by carding, the undrawn conjugate fiber is preferably used in the form of staple fiber of about 30 to 70 mm in length from the standpoint of ease of carding and web-forming capabilities. The resulting carded web is heat treated to have the fibers heat-fusion bonded at their intersections. The heat treatment can be carried out by, for example, blowing hot air to the web or introducing the web into the nip of heat embossing rolls. Hot air blowing (through-air process) is preferred for obtaining nonwoven fabric with a pleasant feel. Whatever method is taken, the heat treating temperature should be at or above the melting or softening point of one of the two resin components and below the melting point of the other resin component.

In particular, using the aforementioned heat-fusible conjugate fiber according to the present invention results in a nonwoven fabric with higher bulk and higher strength as compared with use of conventional nonwoven fabrics made of conjugate fibers of the same materials but prepared in an ordinary process. The reasons accounting for these advantages are described below.

The reasons for the higher bulk are as follows. For one thing, as previously stated, the conjugate fiber of the present invention is characterized by a small heat shrinkage. That is, the individual conjugate fibers hardly shrink when the carded web is heat treated. This means that the carded web can have its fibers fusion-bonded while keeping its bulkiness. If constituent fibers shrink, the carded web would reduce in thickness, leading to a reduction in bulk. For another, seeing that the second resin component of the conjugate fiber according to the present invention has a small orientation index as described above, use of the sheath-core conjugate fiber having the second resin component as a sheath allows for formation of high-strength fusion bonds even with a smaller quantity of heat, i.e., at a lower temperature, than employed conventionally and/or a smaller quantity of hot air than employed conventionally. That the heat treatment can be accomplished at a lower temperature than conventionally employed leads to reduction of thermal shrinkage of the conjugate fiber. That the heat treatment can be accomplished with a smaller quantity of hot air than conventionally required means that a reduction in bulk of the web due to the air pressure is smaller. Thus, the heat treating conditions, as well as the small shrinkage, makes it feasible to produce the nonwoven fabric under such conditions as not to reduce the bulk.

The reasons for the higher strength are as follows. The characteristics of the conjugate fiber of the present invention consist in small thermal shrinkage and the small orientation index of the second resin component (i.e., the fusible component) as previously mentioned. That the conjugate fiber hardly shrinks when the carded web is heat treated means that the intersections of the fibers hardly move while bonded. It follows that the fusion bonds are prevented from reducing the bond strength. If the constituent fibers shrink, the intersections being fused move easily, resulting in a reduction in strength. The smaller orientation index of the fusible component allows for forming fusion bonds with high strength with a smaller quantity of heat than required conventionally. Because the influences of the heating temperature can be minimized, high strength fusion bonds can be formed in a wide range of from low to high temperatures. The resulting fusion bonds are stronger than those of the conjugate fibers made of the same materials but by an ordinary process. Additionally, the fusible component agglomerates uniformly in the fused points to form fusion bonds of almost regular shape. As a result, the fusion bonds show a reduced variation in strength. In short, the fusion bonds of the fibers making up the nonwoven fabric exhibit high strength with a small variation. In general, strength of a nonwoven fabric obtained by blowing hot air to join the fibers by fusion depends heavily on the strength of the fusion bonds. That is, in order to obtain a high-strength nonwoven fabric, it is necessary to maintain a high fusion bond strength level. Should the fusion bond strength varies widely from site to site, the nonwoven fabric fails to enjoy high strength, allowing destruction to start from a weak fusion bond. The use of the conjugate fibers of the present invention, which exhibit high strength at the fusion bonds with a small variation, results in production of a high-strength nonwoven fabric. Moreover, the fibers being less influenced by the heat treatment, the resulting nonwoven fabric exhibits uniform mechanical characteristics.

The nonwoven fabric of the present invention is applicable to various fields with its high bulk and strength being taken into advantage. For example, it is suitable as a topsheet, a second sheet (a sheet interposed between a topsheet and an absorbent member), a backsheet or a leakproof sheet of disposable hygiene articles such as disposable diapers and sanitary napkins, a body cleaning sheet, a skin care sheet, a wipe, etc.

The present invention will now be illustrated in greater detail with reference to Examples, but the present invention should not be construed as being limited thereto.

Examples 1 and 2 and Comparative Examples 1 to 3

Concentric sheath-core conjugate fibers were prepared by high-speed melt spinning under the conditions shown in Table 1 below. The resulting conjugate fibers were analyzed for orientation index and heat shrinkage in accordance with the methods described above. Furthermore, the melting point of the resins and the fusion bond strength of the fibers were measured in accordance with the methods described below. The results obtained are shown in Table 1.

Measurement of Melting Point of Resin

A sample weighing 2 g, prepared by finely cutting the fiber, was analyzed by thermometry with a differential scanning calorimeter, DSC-50 from Shimadzu Corp., at a rate of temperature rise of 10° C./min. The melting peak temperature was taken as the melting point of the resin.

Measurement of Fusion Bond Strength

Figure 2:
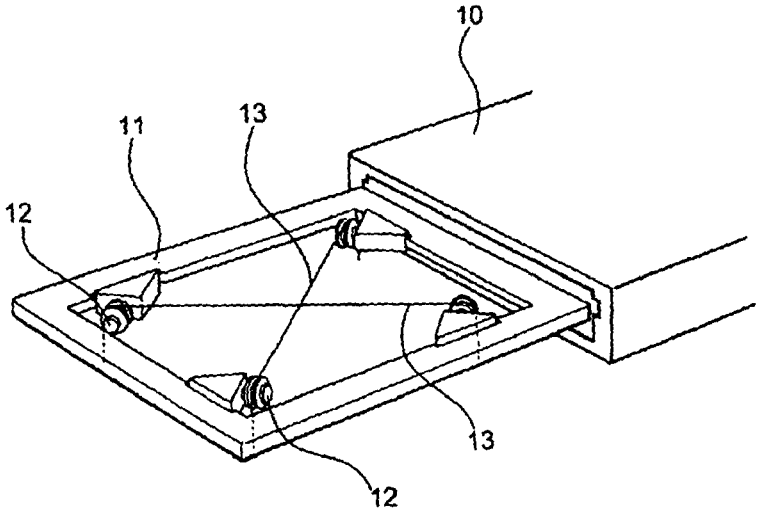
FIG. 2 is a schematic illustrating a device for forming a fusion bond.
Figure 3:
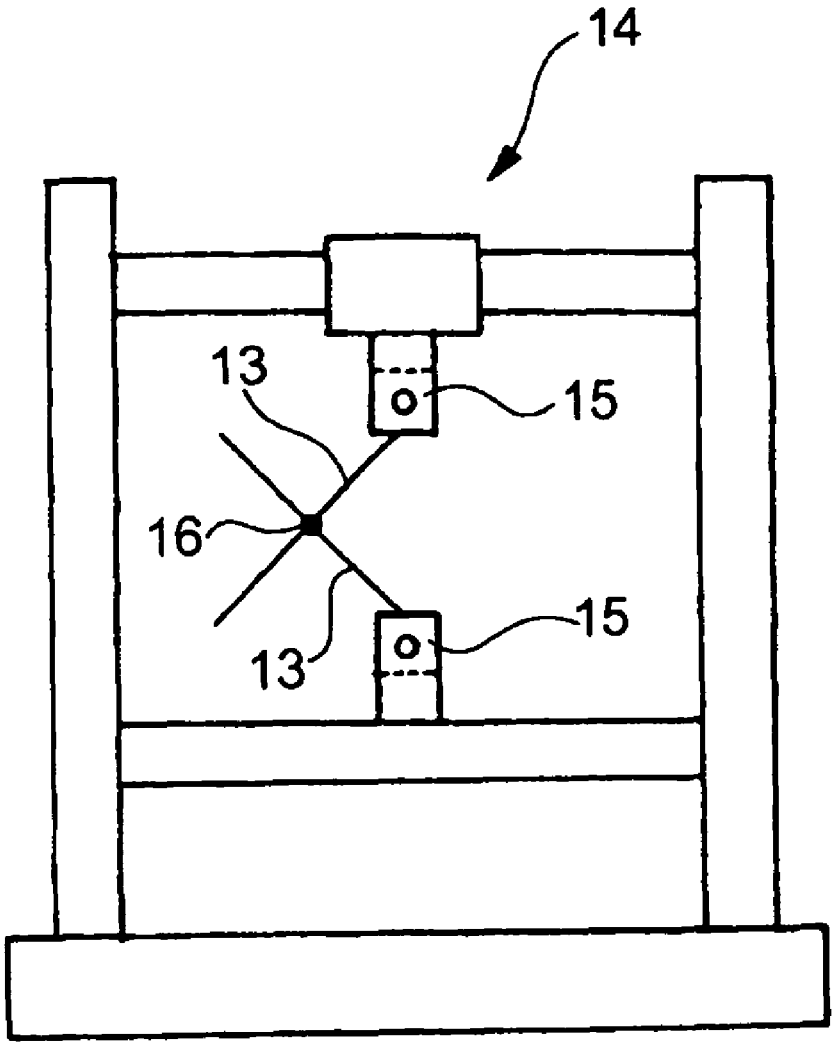
FIG. 3 is a schematic illustrating a tensile tester used in fusion bond strength measurement.

The device for forming a fusion bond shown in FIG. 2 was used. The device has an oven 10 and a frame 11 for straining fibers. The oven 10 is a hollow rectangular parallelepiped equipped with a heater (not shown) in its bottom and having only one of the side faces open. The heater is connected to a temperature controller (not shown) designed to set the ambient temperature inside the oven as prescribed. The frame 11 has a pulley 12 at each of the four corners. Two pairs of diagonally facing two pulleys are each designed to strain a monofilament 13 therebetween so that two monofilaments 13 may intersect at right angles and be in contact with each other at their intersection. Each monofilament 13 has a weight (not shown) attached to both ends thereof to apply a load of 5.88 mN/tex (i.e., 1/15 gf/denier). The oven 10 is configured to have the frame 11 slid in and out through its open side and to heat the monofilaments 13 at a prescribed temperature for a prescribed time to fuse them at their intersection. After fusion bonding, the monofilaments 13 are removed from the frame 11 and set on the tensile tester 14 shown in FIG. 3 in the manner shown. That is, the two monofilaments 13 are attached to the respective chucks 15 at 45° with respect to the tensile direction. The chucks 15 are pulled apart at a speed of 10 mm/min to separate the fusion bond 16, and the maximum load observed in the debonding is read out. This maximum load depends on the absolute amount of the fusible resin component, i.e., the fiber thickness and the sheath to core ratio. Therefore, a value obtained by dividing the maximum load by the fiber thickness (tex) is taken as a fusion bond strength (mN/tex). According to the present invention, a fusion bond strength higher than 30 mN/tex, preferably exceeding 35 mN/tex, can be reached under heating conditions of 145° C. and 30 seconds.

TABLE 1

| | | Example | | Comparative Example | | |
|---|---|---|---|---|---|---|
| | | 1 | 2 | 1 | 2 | 3 |
| 1st Resin Component | | PP | PP | PP | PP | PP |
| 2nd Resin Component | | HDPE | HDPE | HDPE | HDPE | HDPE |
| Spinneret Temp (° C.) | | 255 | 255 | 255 | 255 | 255 |
| Spinning Speed (m/min) | | 2000 | 3000 | 1000 | 500 | 335 |
| Draw Ratio | | 0 | 0 | 2 | 4 | 6 |
| Orientation Index (%) | 1st Resin Component | 64 | 73 | 92 | 106 | 118 |
| | 2nd Resin Component | 21 | 10 | 63 | 65 | 73 |
| Heat Shrinkage (%)* | | 0.05 | −0.01 | 6.00 | 5.99 | 7.47 |
| Melting Point (° C.) | 1st Resin Component | 163 | 163 | 161 | 168 | 170 |
| | 2nd Resin Component | 128 | 128 | 129 | 132 | 132 |
| Fusion Bond Strength (mN/tex) | 140° C./30 s | 38.2 | 38.1 | 25.0 | 6.7 | 0.5 |
| | 145° C./20 s | 36.1 | 39.1 | 30.2 | 16.9 | 28.8 |
| | 145° C./30 s | 35.6 | 36.8 | 25.0 | 22.8 | 22.5 |
| | 145° C./40 s | 38.3 | 36.2 | 16.2 | 19.3 | 20.2 |

*Measured at a temperature higher than the melting point of the second resin component by 10° C.

Examples 3 and 4 and Comparative Examples 4 to 6

Each of the conjugate fibers obtained in Examples 1 and 2 and Comparative Examples 1 to 3 was cut into staple fiber of 51 mm length, and the staple fiber was two-dimensionally crimped by mechanical crimping. The crimped staple fiber was carded into a web. Hot air at 135° C. was blown to the carded web at a velocity of 0.5 m/sec for 30 seconds by a through-air process to obtain an air-through nonwoven fabric in which the individual fibers were fusion bonded at their intersections. While, in the above-described fusion bond strength measurement, the fusion bond was formed at the ambient temperature, the air-through nonwoven fabric was obtained by blowing hot air by means of a fan. It should be noted, therefore, that the heating conditions are not quite the same even with the temperature and time conditions being equal.

The resulting nonwoven fabrics were evaluated for bulkiness and measured for strength at break in accordance with the methods below. The results obtained are shown in Table 2.

Evaluation of Bulkiness

A 12 cm-side square plate was mounted on a measuring stage. The vertical position of the upper surface of the plate was taken as a base point A. The plate was once removed, a test piece of a nonwoven fabric was placed on the measuring stage, and the plate was put thereon. The vertical position of the upper surface of the plate was taken as point B. The difference between points A and B was taken as the thickness of the test piece. The weight of the plate is subject to alteration depending on the purpose of the measurement. Here, a plate weighing 54 g was used. Measurements were made with a laser displacement meter (CCD laser displacement sensor LK-080, from Keyence Corp.). A dial gauge type thickness meter will do in place of the displacement meter, in which case, however, the load applied to the test piece should be adjusted. Considering that the thickness of a nonwoven fabric largely depends on the basis weight, a specific volume ($cm^3/g$) calculated from thickness and basis weight was adopted as a measure of bulkiness. While the basis weight can be measured by an arbitrary method, it is conveniently obtained by weighing the test piece used in the thickness measurement and dividing the area of the test piece by the weight.

Measurement of Nonwoven Fabric Strength

A specimen measuring 25 mm in the machine direction and 100 mm in the direction perpendicular to the machine direction (i.e., CD) was cut out of the sample nonwoven fabric. The specimen was set on a Tensilon tensile tester at a chuck distance of 75 mm and pulled at a speed of 300 mm/min. The maximum load in the pulling was taken as the strength of the nonwoven fabric. Because the nonwoven fabric strength largely depends on the basis weight, a quotient obtained by dividing the strength by the basis weight was adopted as a CD strength per basis weight indicative of the nonwoven fabric strength.

TABLE 2

| | Example | | Comparative Example | | |
|---|---|---|---|---|---|
| | 3 | 4 | 4 | 5 | 6 |
| Specific Volume ($cm^3/g$) | 98.72 | 110.47 | 95.27 | 65.54 | 64.92 |
| CD Strength per Basis Weight ((N/25 mm)/($g/m^2$)) | 0.27 | 0.24 | 0.19 | 0.08 | 0.02 |
| MD Bulk Softness per Unit Thickness (N/mm) | 0.10 | 0.12 | 0.15 | 0.15 | 0.21 |

As is apparent from the results in Tables 1 and 2, the conjugate fibers of Examples (products according to the present invention) exhibit low heat shrinkage and high fusion bond strength. It is also seen that the nonwoven fabrics of Examples are bulky and with high strength.

Example 5 and Comparative Examples 7 and 8

Concentric sheath-core conjugated fibers were obtained by melt spinning under the conditions shown in Table 3. The resulting conjugated fibers were examined for orientation index and heat shrinkage, and the melting point of the resins and the fusion bond strength of the fibers were measured in the same manner as described above. The results obtained are shown in Table 3.

TABLE 3

| | | Example 5 | Comparative Example 7 | Comparative Example 8 |
|---|---|---|---|---|
| 1st Resin Component | | PP | PP | PP |
| 2nd Resin Component | | HDPE | HDPE | HDPE |
| Spinneret Temperature (° C.) | | 250 | 250 | 250 |
| Spinning Speed (m/min) | | 1360 | 760 | 390 |
| Draw Ratio | | 0 | 2 | 4 |
| Orientation Index (%) | 1st Resin Component | 60 | 68 | 95 |
| | 2nd Resin Component | 16 | 50 | 64 |
| Heat Shrinkage (%)* | | −0.33 | 4.88 | 1.09 |
| Melting Point (° C.) | 1st Resin Component | 160 | 160 | 165 |
| | 2nd Resin Component | 127 | 129 | 130 |
| Fusion Bond Strength (mN/tex) | 140° C./30 s | 32.9 | 38.2 | 37.0 |
| | 145° C./20 s | 37.8 | 30.1 | 32.6 |
| | 145° C./30 s | 33.8 | 37.0 | 33.5 |
| | 145° C./40 s | 33.5 | 25.3 | 39.7 |

TABLE 3-continued

| | Example 5 | Comparative Example 7 | Comparative Example 8 |
|---|---|---|---|

*Measured at a temperature higher than the melting point of the second resin component by 10° C.

Examples 6 to 9 and Comparative Examples 9 to 16

Air-through nonwoven fabrics were obtained in the same manner as in Example 3, except for using the fibers prepared in Example 5 and Comparative Example 7. The through-air processing conditions are shown in Table 4. The resulting nonwoven fabrics were examined for specific volume and strength per basis weight in accordance with the methods described above. Furthermore, the bulk softness of the nonwoven fabrics was determined. Additionally, the feel of the nonwoven fabrics was organoleptically evaluated and grated by five panel members. The scale for grating the feel are described below. The results are shown in Table 4.

Measurement of Bulk Softness

A sample measuring 30 mm in the MD and 150 mm in the CD was cut out from the nonwoven fabric and made into a 45 mm diameter, 30 mm high cylindrical specimen. The cylindrical specimen was compressed in the height direction at a rate of 10 mm/min, and the repulsive force was measured. The repulsive force was taken as a value of bulk softness in the MD. Bulk softness in the CD was obtained in the same manner except for using a sample measuring 30 mm in the CD and 150 mm in the MD cut out of the nonwoven fabric. The bulk softness thus measured largely depends on the thickness of the nonwoven fabric. Hence, the measured bulk softness value was divided by the thickness as measured in the bulkiness evaluation to give a bulk softness per unit thickness, which was taken as a measure of drapability.

Scale for Grating Feel by Organoleptic Test

The tactile qualities of the nonwoven fabric was graded and averaged on the following scale. The nonwoven fabric of Comparative Example 9 shown in Table 4 was taken as a reference product graded 3.

5: Much superior to the reference product.
4: Superior to the reference product.
3: Reference product.
2: Inferior to the reference product.
1: Much inferior to the reference product.

TABLE 4

| | Through-Air Processing Conditions | | | Basis Weight | Specific Volume | Strength per Basis Weight ((N/25 mm)/(g/m²)) | | Bulk Softness Per Unit Thickness (N/mm) | | |
|---|---|---|---|---|---|---|---|---|---|---|
| | Temp. (° C.) | Velocity (m/s) | Convey Speed (m/min) | (g/m²) | (cm³/g) | MD | CD | MD | CD | Feel |
| Ex. 6 | 132 | 0.5 | 10 | 38.0 | 122.4 | 0.80 | 0.20 | 0.09 | 0.06 | 4.8 |
| Comp. Ex. 9 | 132 | 0.5 | 10 | 36.2 | 105.9 | 0.92 | 0.17 | 0.24 | 0.12 | 3.0 (ref.) |
| Comp. Ex. 10 | 132 | 0.5 | 10 | 39.0 | 138.4 | 0.91 | 0.13 | 0.12 | 0.08 | 5.0 |
| Ex. 7 | 136 | 0.5 | 10 | 32.5 | 204.6 | 0.68 | 0.24 | 0.08 | 0.05 | 4.0 |
| Comp. Ex. 11 | 136 | 0.5 | 10 | 36.7 | 103.2 | 0.86 | 0.20 | 0.23 | 0.17 | 2.8 |
| Comp. Ex. 12 | 136 | 0.5 | 10 | 36.9 | 119.9 | 1.10 | 0.16 | 0.16 | 0.10 | 3.4 |
| Ex. 8 | 136 | 1.9 | 10 | 28.2 | 159.8 | 0.83 | 0.23 | 0.08 | 0.06 | 3.8 |
| Comp. Ex. 13 | 136 | 1.9 | 10 | 41.5 | 99.2 | 0.93 | 0.19 | 0.31 | 0.23 | 1.0 |
| Comp. Ex. 14 | 136 | 1.9 | 10 | 34.7 | 107.5 | 1.10 | 0.21 | 0.22 | 0.15 | 2.0 |
| Ex. 9 | 140 | 0.5 | 10 | 36.6 | 141.9 | 0.80 | 0.22 | 0.09 | 0.07 | 4.0 |
| Comp. Ex. 15 | 140 | 0.5 | 10 | 42.6 | 87.9 | 0.84 | 0.19 | 0.35 | 0.20 | 1.8 |
| Comp. Ex. 16 | 140 | 0.5 | 10 | 35.2 | 65.0 | 1.20 | 0.24 | 0.40 | 0.23 | 1.0 |

As is apparent from the results in Tables 3 and 4, the nonwoven fabrics of Examples 6 to 9, which were made of the conjugate fiber of Example 5, proved to have high bulkiness, high strength, and low bulk softness. The nonwoven fabrics of Examples 6 to 9 also roved pleasant to the touch notwithstanding the high strength.

INDUSTRIAL APPLICABILITY

As described in detail, the heat fusible conjugate fiber according to the present invention has low heat shrinkage and high fusion bond strength and satisfactory carded web-forming capabilities.

The nonwoven fabric according to the present invention has high bulk and exhibits high strength even when produced at a lower heating temperature than conventionally employed.

The nonwoven fabric of the present invention has excellent drapability and a good feel.

The invention claimed is:

1. A heat fusible conjugate fiber produced by high-speed melt spinning, and after the spinning, a crimp treatment but no drawing, which comprises:

a first resin component having an orientation index of 40% or higher; and a second resin component having a lower melting or softening point than the melting point of the first resin component and an orientation index of 16% or lower, the second resin component being present on at least part of the surface of the fiber in a lengthwise continuous configuration, wherein said fiber has negative heat shrinkage values at a temperature higher than the melting point or softening point of the second resin component by 10° C., and increases in length upon heating, and wherein the heat fusible conjugate fibers are staple fibers of 30 to 70 mm in length;

wherein the first resin component comprises polypropylene, and the second resin component comprises high-density polyethylene;

wherein the take-up speed during high-speed melt spinning is 1360 m/min or higher;

wherein said fiber has a negative heat shrinkage value of at least −0.33% to −20% at a temperature higher than the melting point or softening point of the second resin component by 10° C., and increases in length upon heating.

2. The heat fusible conjugate fiber according to claim 1, having a sheath-core configuration in which the first resin component makes the core, and the second resin component makes the sheath.

3. A nonwoven fabric produced by providing a carded web comprising the heat fusible conjugate fiber according to claim 1 and heat fusing the intersections of the fibers constituting the web.

4. A bulky nonwoven fabric comprising heat fusible conjugate fibers comprising two components having different melting points, formed by heating fusible conjugate fibers and heat fusing the intersections of the fibers, wherein the bulky nonwoven fabric has a specific volume of 95 $cm^3/g$ or more, a strength per basis weight of 0.18 (N/25 mm)/($g/m^2$) or higher, and a bulk softness per unit thickness of 0.14 N/mm or less, wherein the fusible conjugate fibers are produced by high-speed melt spinning, and after the spinning, a crimp treatment but no drawing, and comprise a first resin component having an orientation index of 40% or higher and a second resin component having a lower melting or softening point than the melting point of the first resin component and an orientation index of 16% or lower, the second resin component being present on at least part of the surface of the fiber in a lengthwise continuous configuration, wherein said fibers have negative heat shrinkage values at a temperature higher than the melting point or softening point of the second resin component by 10° C., and increase in length upon heating, and wherein the heat fusible conjugate fibers are staple fibers of 30 to 70 mm in length;

wherein the first resin component comprises polypropylene, and the second resin component comprises high-density polyethylene;

wherein the take-up speed during high-speed melt spinning is 1360 m/min or higher;

wherein said fibers have a negative heat shrinkage value of at least −0.33% to −20% at a temperature higher than the melting point or softening point of the second resin component by 10° C., and increase in length upon heating.

5. The bulky nonwoven fabric according to claim 4, which is produced by providing a carded web and heat fusing the intersections of the fibers in the web by blowing hot air.

6. The heat fusible conjugate fiber of claim 1, wherein, after the spinning, a crimp treatment but no heating or drawing is performed.

* * * * *